US005533688A

United States Patent [19]

Pace

[11] Patent Number: 5,533,688

[45] Date of Patent: Jul. 9, 1996

[54] ROLL REWINDER APPARATUS

[76] Inventor: William Pace, 849 160th St., Hammond, Wis. 54015

[21] Appl. No.: 298,007

[22] Filed: Aug. 30, 1994

[51] Int. Cl.[6] ..... B65H 23/198

[52] U.S. Cl. ..... 242/413.2; 242/422.2; 242/538; 242/548; 242/547

[58] Field of Search ..... 242/413.2, 422.2, 242/538, 548, 548.2, 566, 547; 226/97, 196, 197, 199

[56] References Cited

U.S. PATENT DOCUMENTS

| | | | |
|---|---|---|---|
| 2,590,005 | 3/1952 | Glenn | 242/538 |
| 2,874,917 | 2/1959 | Pell | 242/413.2 |
| 3,218,000 | 11/1965 | Blackman et al. | 242/548.2 |
| 3,387,798 | 6/1968 | Young | 242/548 |
| 3,471,099 | 10/1969 | Albert | 242/413.2 |
| 3,495,790 | 2/1970 | Fisnar | 242/538 |
| 3,604,650 | 9/1971 | Wennerberg | 242/538 |
| 3,653,602 | 4/1972 | Harrington | 242/548.2 |
| 3,854,668 | 12/1974 | Rudd | 242/413.2 |
| 3,949,949 | 4/1976 | Thompson | 242/422.2 |
| 4,166,590 | 9/1979 | Dennhardt | 242/413.2 |
| 4,290,563 | 9/1981 | Brooks et al. | 242/566 |
| 5,224,641 | 7/1993 | Spicer | 226/97 |

*Primary Examiner*—John M. Jillions
*Attorney, Agent, or Firm*—Joel D. Skinner, Jr.

[57] ABSTRACT

A rewinder for use in unwinding flexible tape-like material from a detective roll and winding it on to a new, properly formed roll. The rewinder includes an unwind station and a wind station. Each station comprises a spool holder and several rollers, including air powered rollers that reduce friction between the guide and the through-put material. A tension arm assembly, in cooperation with a control panel and a DC drive motor, regulates through-put speed. Control and adjustment mechanisms are disclosed.

10 Claims, 11 Drawing Sheets

ROLL REWINDER APPARATUS

BACKGROUND OF THE INVENTION

1. Field of the Invention

This invention relates to apparatus for rewinding rolls of flexible, elongated, tape or strap like material, and more particularly to an apparatus for rewinding material from a defective roll onto, a corrected roll. The rewinder apparatus of this invention is particularly useful for rewinding paper, synthetic films, metal foil, cloth and similar substances.

2. Background Information

In the past, devices and methods has been used to rewind material, and particularly for rewinding material from a detective roll onto a corrected roll. However, these devices and methods have significant limitations and shortcomings.

Despite the need in the art for a rewinder which overcomes the shortcomings and limitations of the prior art, none insofar as is known has been developed or proposed. Accordingly, it is an object of the present invention to provide an improved rewinder apparatus that can be used to remove material from a roll having a crushed core or a telescoping core or which has improperly spliced material or which requires a new splice in the material, and to rewind the material onto a new core. It is a further object of this invention to provide a rewinder apparatus which is effective, reliable, easy to operate and economical to manufacture, and which overcomes the limitations and shortcomings of the prior art.

SUMMARY OF THE INVENTION

The apparatus of the present invention provides an apparatus for rewinding flexible elongated material from one roll onto another roll, comprising:

(a) an unwind station comprising a holder for a first roll of wound material and at least one guide, the guide being disposed at a predetermined position with respect to the holder;

(b) wind station comprising at least one guide and a holder for a second roll of wound material, the wind station guide being disposed at a predetermined position with respect to the wind station holder and to the unwind station guide; and (c) means to drive the wind station holder, whereby material extending the unwind station holder travels around the unwind guide, around the wind station guide and is rewound onto the wind station holder.

In a preferred embodiment, the invention provides an apparatus for rewinding flexible elongated material from one detective roll onto a corrected roll, comprising:

(a) a frame;

(b) an unwind station disposed on the frame and comprising a rotatable holder for a first roll of wound material, first and second rotatable intermediary guides disposed at predetermined positions with respect to the holder, a rotatable terminal guide having an adjustable position, and means to positively brake rotation of the holder, the holder and the guides having a cylindrical configuration and being vertically axially oriented with respect to the frame;

(c) a wind station comprising a sub-frame connected to and extending above the frame, a first air driven guide connected to the sub-frame, a first rotatable guide connected to the sub-frame, an arm pivotally connected at one of its ends to the sub-frame, a second rotatable guide connected to the arm at its opposite end, a second air driven guide connected to the arm proximate its midpoint, a holder, disposed on the sub-frame, for a second roll of wound material;

(d) a motor connected to and driving the wind station holder; and (e) means to regulate the, drive speed of the wind station holder by the motor, whereby material extending from the unwind station holder travels around the unwind guides, around the wind station guides and is rewound onto the wind station holder at a substantially constant speed.

The features, benefits and objects of this invention will become clear to those skilled in the an: by reference to the blowing description, claims and drawings.

DESCRIPTION OF THE PREFERRED EMBODIMENTS

The present invention provides a rewinder apparatus which is usable to rewind rolled material. In particular, the rewinder is useable to rewind the material, for example polymeric film (polyester, high and low density polyethylene, for example), cloth, paper and the like, from a malformed roll onto a new roll in a proper format. Examples of malformed or defective rolls that can be remedied by the apparatus of the present invention include crushed cores, telescoped cores (i.e. cores that protrude from one end of the roll)and improperly spliced materials. the apparatus shown processes 3.5 inch wide material in a variety of thicknesses and in rolls of approximately 14–16 inches in diameter with a 3 inch diameter core or center cavity. The teachings of this invention are adaptable to machines having the capability to process ⅛th inch-10 inch wide material. The apparatus has a variable processing speed, but optimally operates at a throughput rate of approximately 1500 feet/minute.

Figure 1:
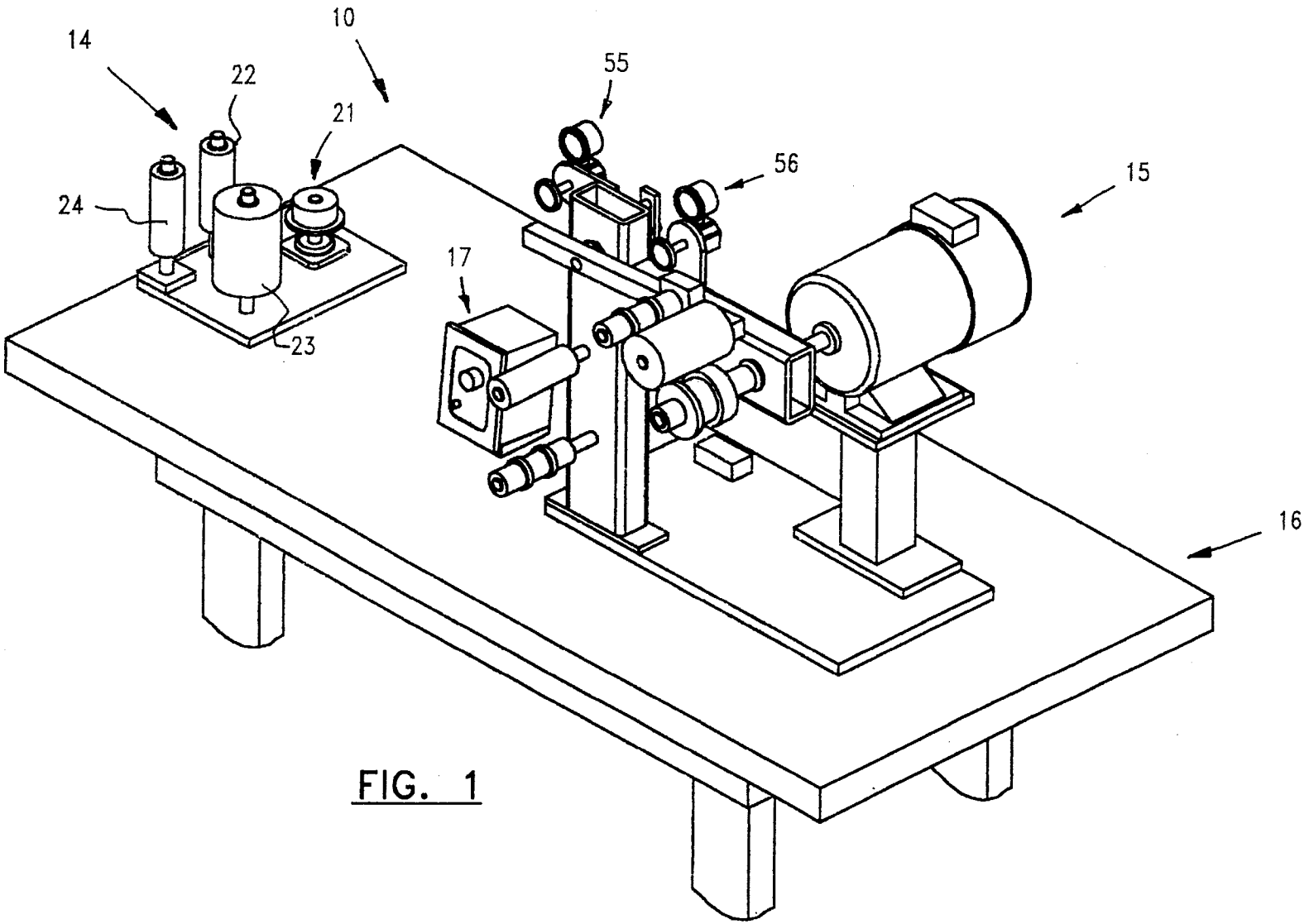
FIG. 1 is a perspective view of the roll rewinder apparatus of the present invention.
Figure 2:
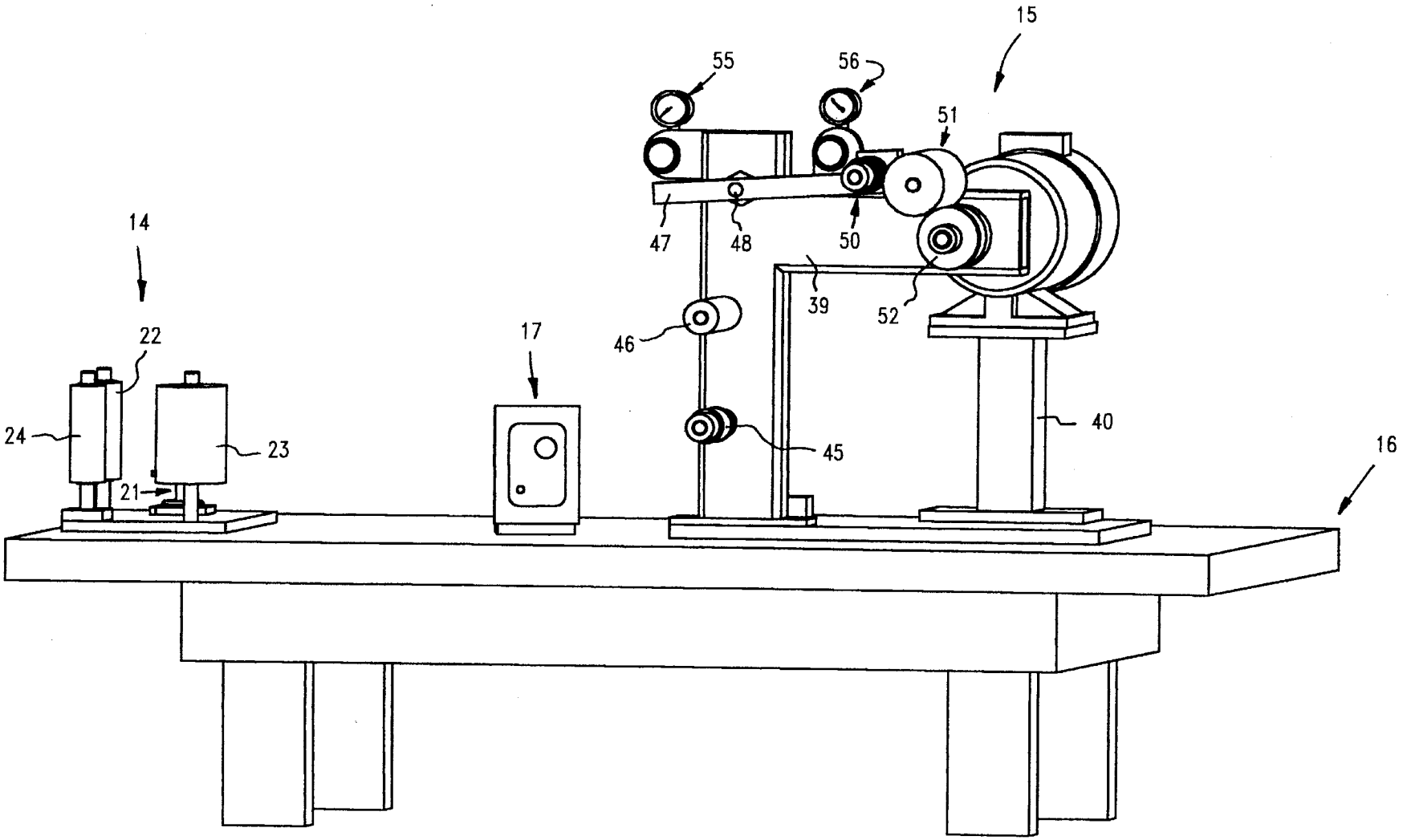
FIG. 2 is another perspective view of the rewinder.
Figure 10:
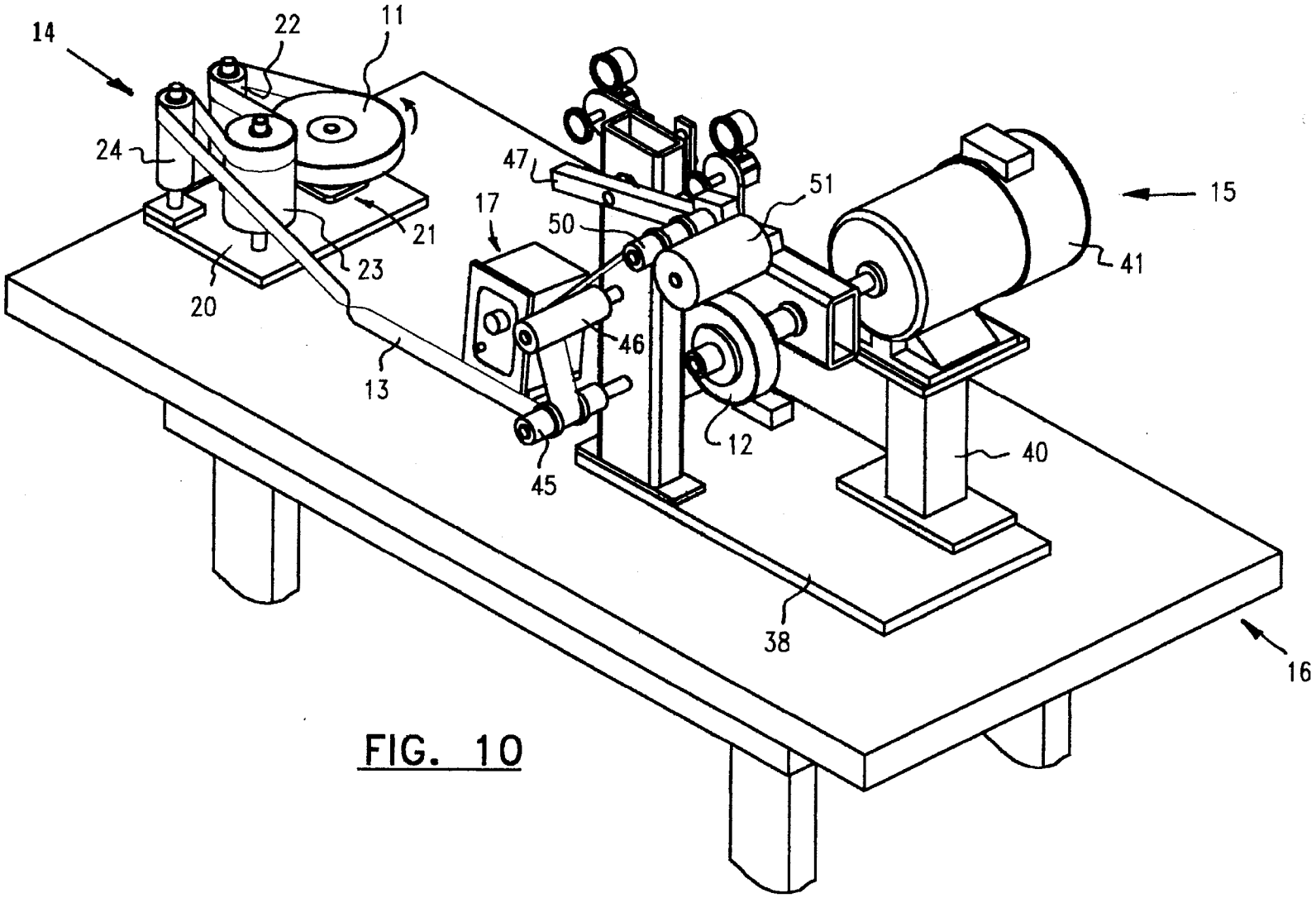
FIG. 10 is a view of the rewinder showing unwind and wind rolls of a film material loaded in an operative orientation.

Referring to FIGS. 1, 2 and 10, the rewinder 10 is shown with a first or unwind roll 11 of material which is threaded operatively in the rewinder 10 and extends to a second or wind roll 12. The first roll 11 is malformed and is being processed into the well formed roll 12.

The rewinder 10 generally comprises a first or unwind station 14, a second or wind station 15, a base or frame 16 and a controller 17. The first roll 11 is disposed at the unwind station 14 and the second roll 12 is disposed at the wind station 15. The controller 17 is an electronic device which permits the operator to control the various functions of the apparatus 10 (described in detail below), including the speed of the rewind process.

Figure 8:
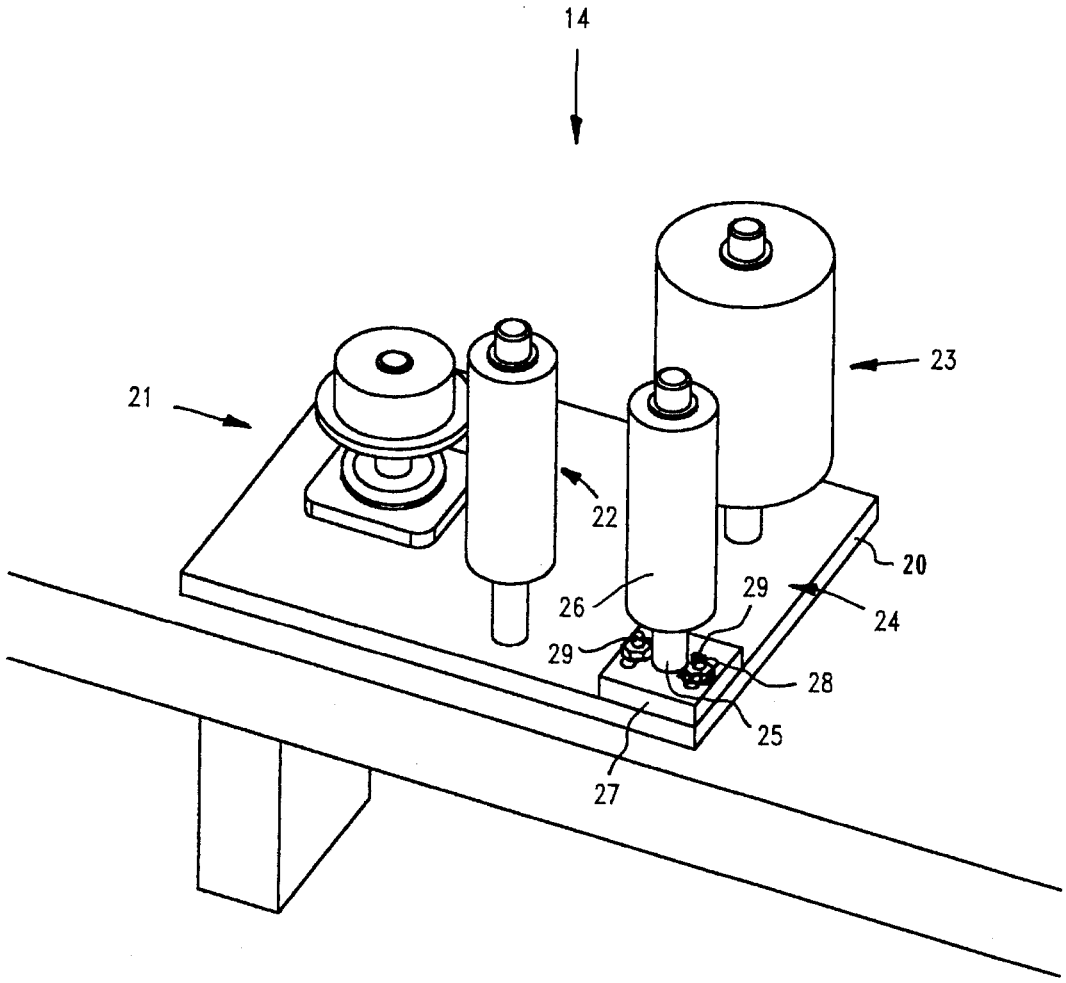
FIG. 8 is a perspective view of the unwind station of the rewinder.
Figure 9:
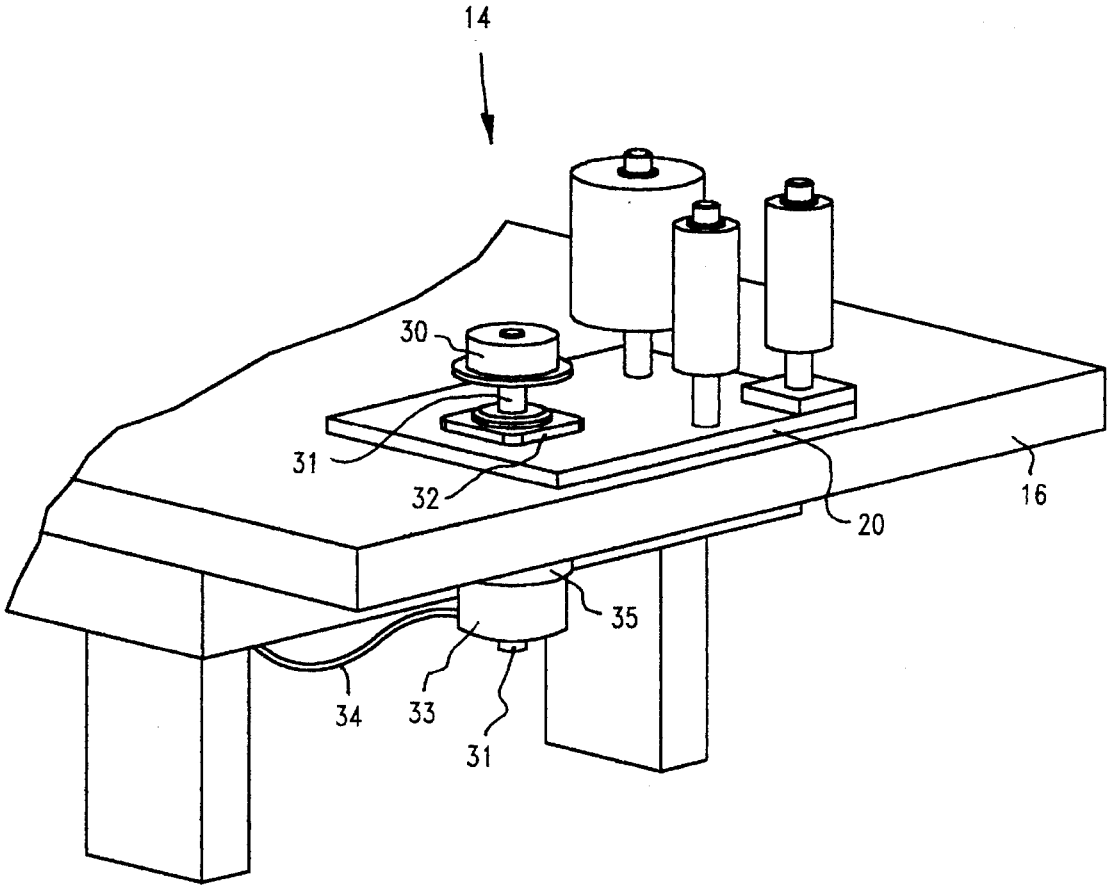
FIG. 9 is a view of the bottom of the unwind station.

Referring to FIGS. 8 and 9, the unwind station 14 comprises a base plate 20, an unwind spool or roll holder 21, and a plurality of rollers 22–24. The base plate 20 is a metal plate having a predetermined area sufficient to mount the other elements of the unwind station 14. The base, plate 20 is fixed in position at one end of the frame 16. The unwind roll holder 21 holds the unwind roll 11 and comprises a metal cylindrical head 30 freely rotatably connected to a vertically oriented shaft 31. The head 30 has an outside diameter which is slightly smaller than the inside diameter of the core of the spool 11 and further has retainers for frictionally engaging the interior wall of the core. The shaft 31 is connected to a first bearing block 32 and extends through to a second bearing block located on a bottom surface of the frame 16. A pneumatic brake 33 is connected to the second block 35. An air line 34 extend from the brake 33 to a control mechanism discussed below. The brake 33 permits fast stopping of rotation of the unwind holder 21.

The rollers of the unwind station 14 engage the threaded material and apply tension thereto. The rollers are all oriented vertically and include a first roller 22 which is disposed a predetermined distance from the unwind spool holder 21. The first roller 22 is the closest roller to the unwind holder 21. The roller 22 comprises a head rotatably attached to a shaft which is fixed to the plate 20. The head is constructed of nylon or the like and has an height of approximately 4 inches. Importantly, the width of the head is greater than that of the processed material. The second roller 23 also comprises a rotatable head attached to a shaft. The head is slightly larger in diameter than that of the first roller 23. The second head is disposed in a predetermined position on the plate 20, out of line with the roll holder 21 and the first head 22 and closer to the wind station 15. The third roller 24 comprises a head 26, a shaft 25 and a bearing block 27. The third head is disposed on the plate 20 in alignment with the spool holder 21 and the first roller 22. The aligned position of the bearing block 27 (the distance from the first roller 22) is adjustable by means of securement bolts 29 which extend through adjustment slots 28 in the block 27. Adjustment of the position of the third roller permits fine tuning of the alignment of the unwind station 14 with the wind station 15 to vary the level of twist in the material, as describe further below.

Figure 3:
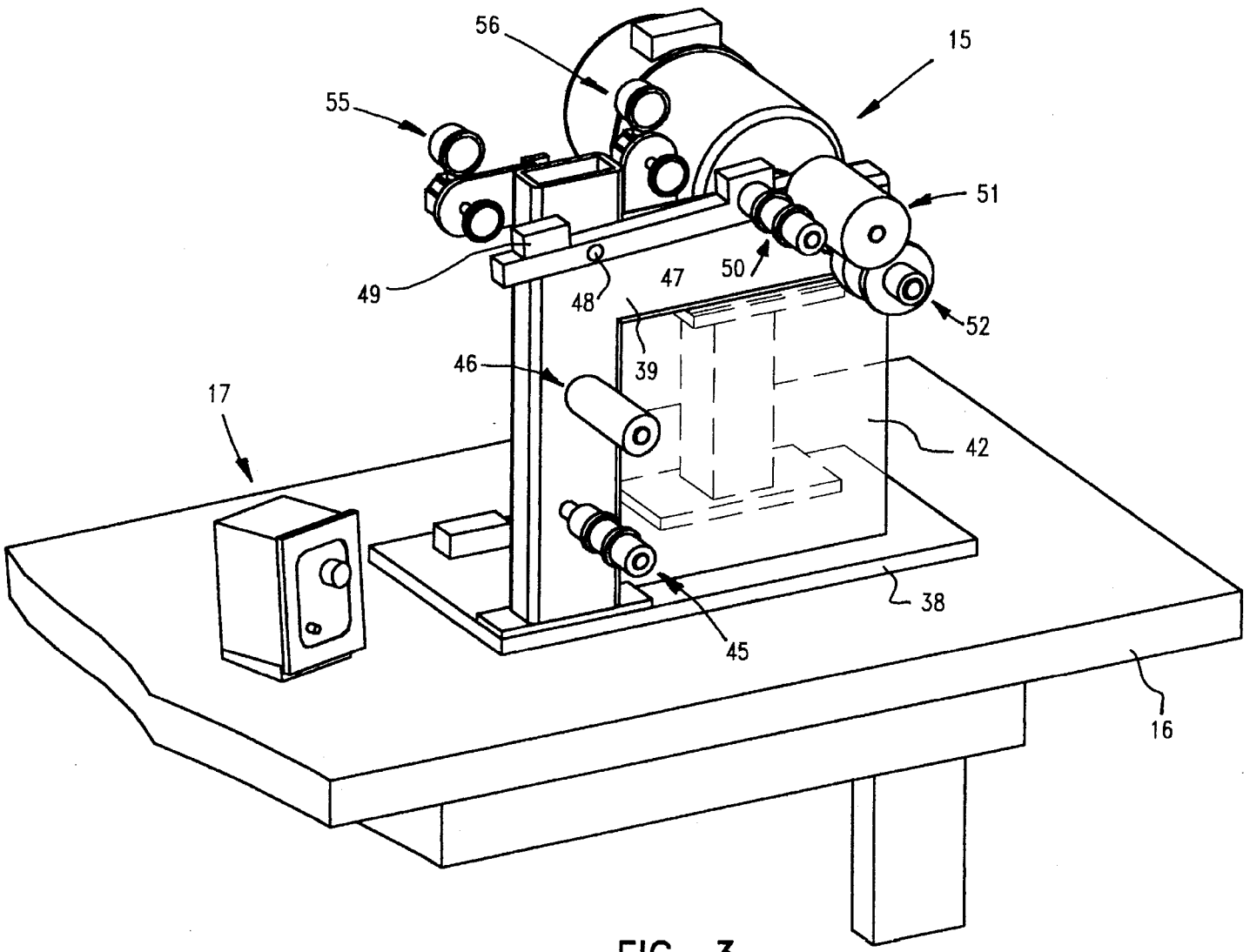
FIG. 3 is a perspective view of the wind station of the rewinder.
Figure 4:
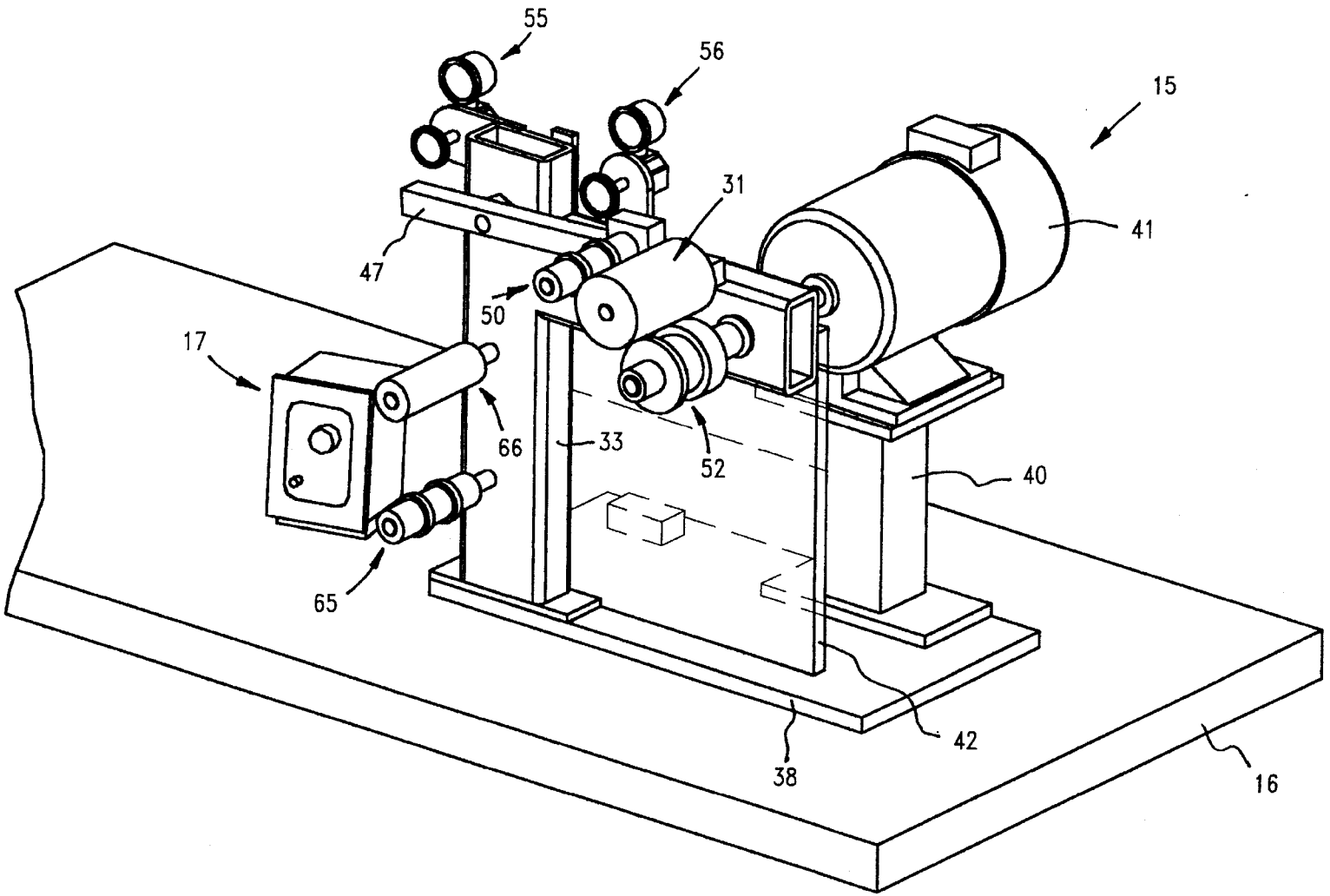
FIG. 4 is another perspective view of the wind station.
Figure 5:
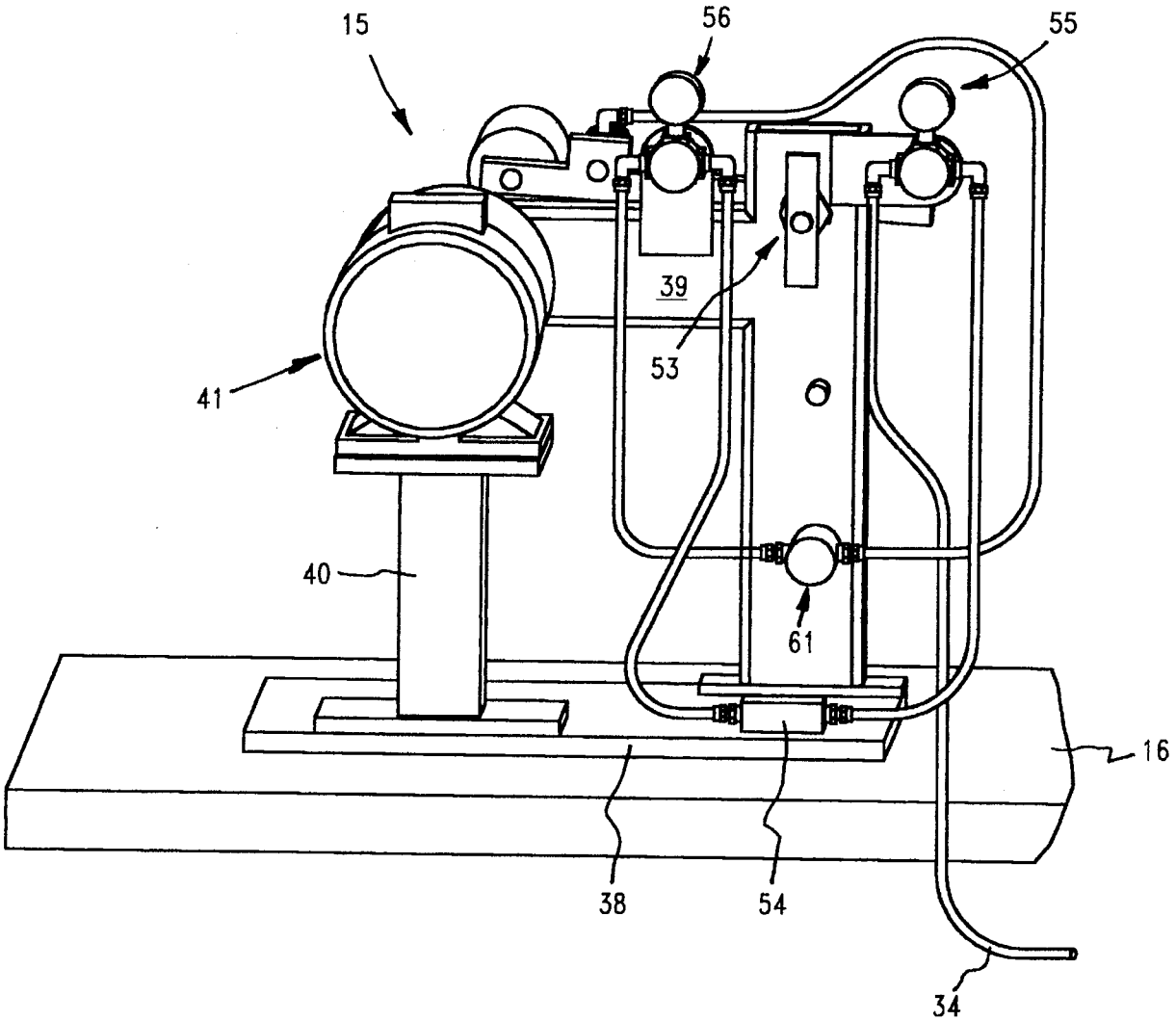
FIG. 5 is a view of the back of the wind station.

Referring to FIGS. 3–5, the wind station 15 generally comprises a frame assembly, a motor 41, a safety screen 42, a plurality of roller members, a pivotable assembly and a pneumatic control mechanism. The frame assembly includes a flat base plate 38 attached to the apparatus frame 16, an L-shaped main frame 39 and a motor support frame 40. The motor 41 is disposed on the top of the motor support frame 40. The motor 41 is a 0.75 horsepower DC motor, manufactured by Baldor for example. The motor 41 speed is controlled by the controller 17.

The rollers of the wind station 15 are all oriented horizontally and include a first air guide 45, a first roller 46, a second air guide 50, a second or lay-on roller 51, and a wind spool or roll holder 52. The first air guide 45 and first roller 46 are disposed on the from side of the vertical member of the main frame 39. The first air guide 45 is disposed below and in vertical alignment with the first roller 46. The second air guide 50 and second roller 51 are disposed on a tension arm 47. The second roller 51 is disposed at the end of the arm 47 and the second air guide 50 is disposed adjacent the second roller 51.

Figure 6:
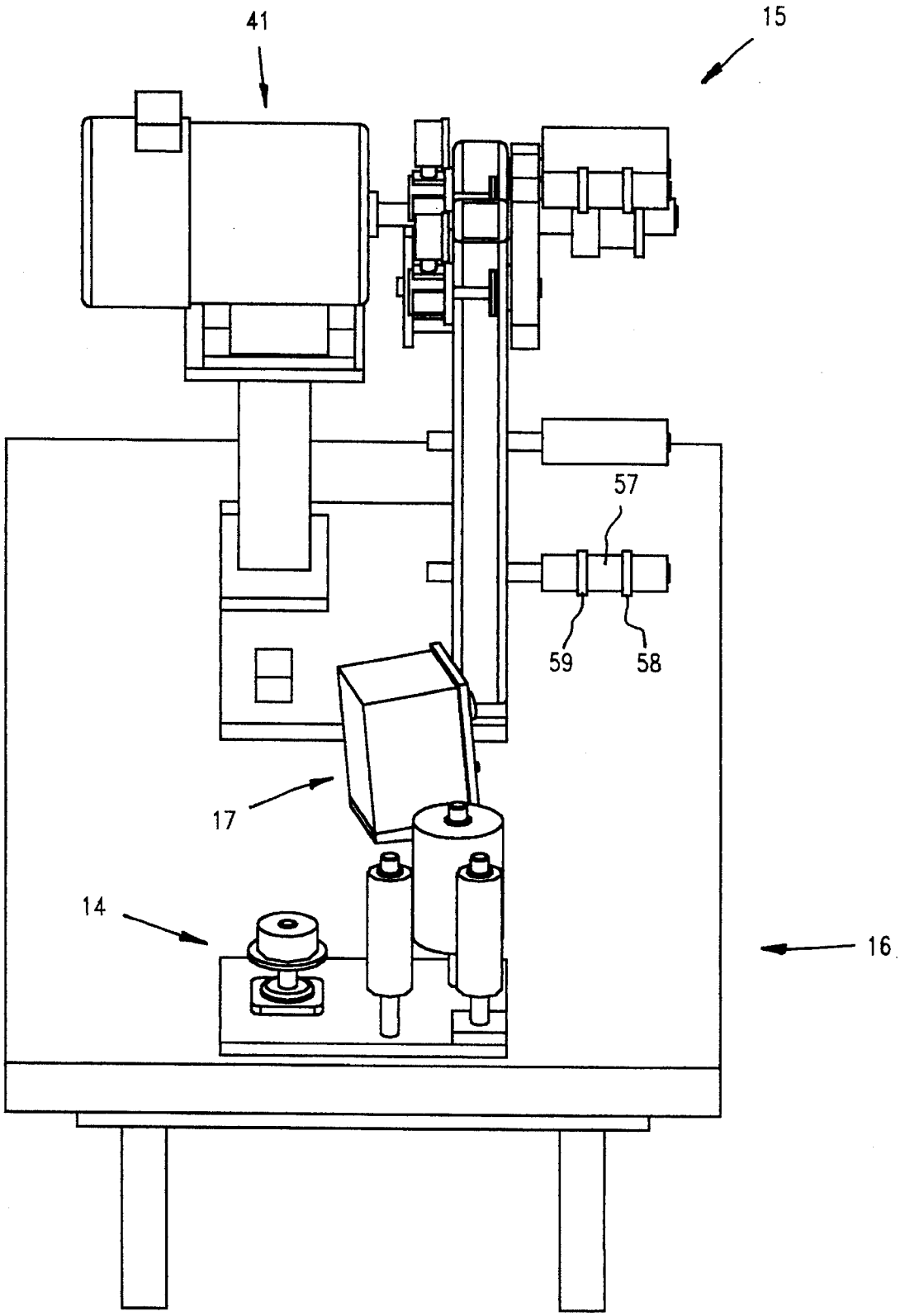
FIG. 6 is a view of an end of the rewinder.
Figure 7:
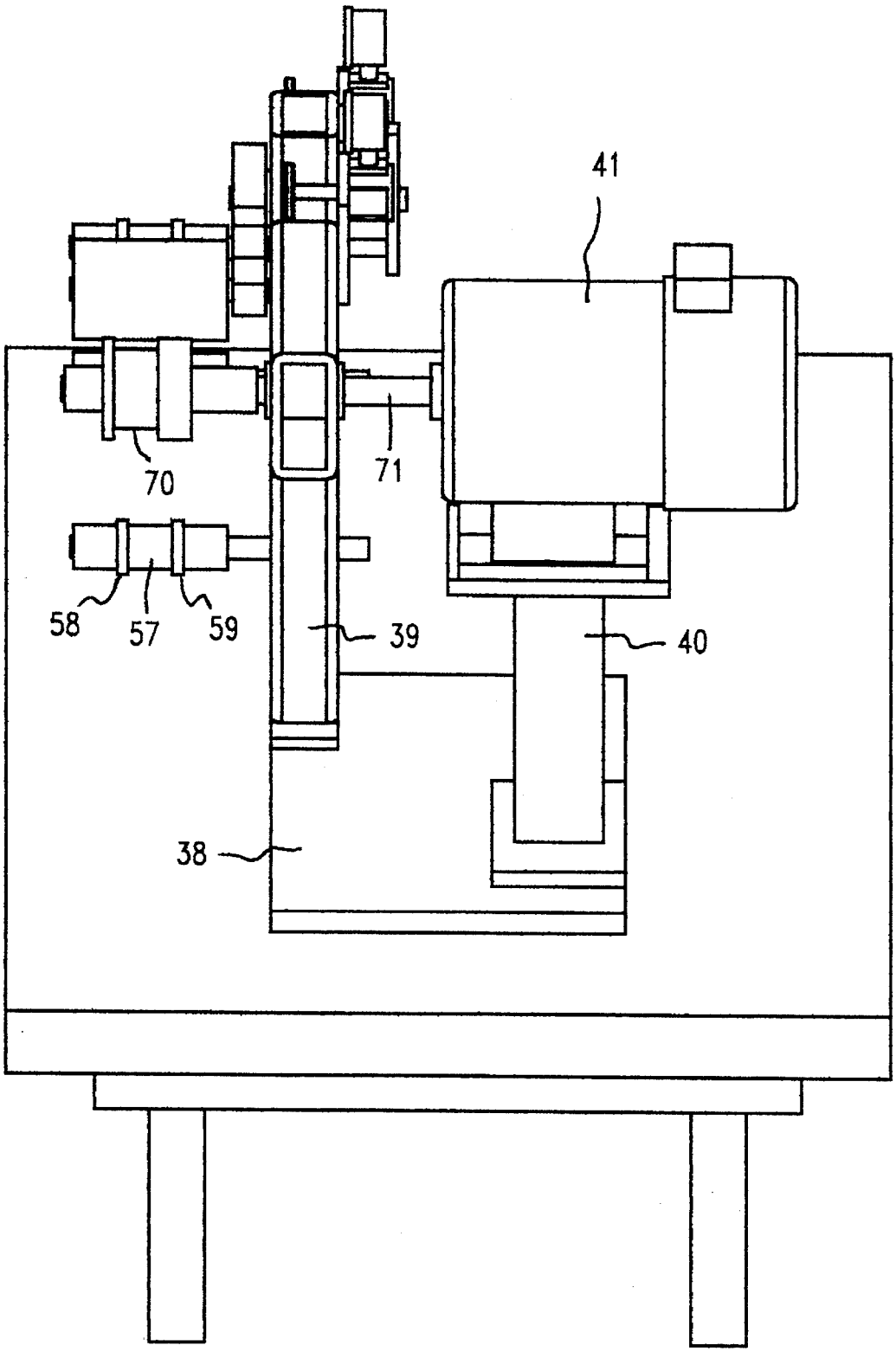
FIG. 7 is an opposite end view of the rewinder.

The rollers 46 and 50 each comprise a nylon head rotatably connected to a fixed shaft. This design and function of these rollers 46 and 50 are identical to the design and function of the rollers of the unwind station 14. Referring also to FIGS. 6 and 7, the air guides 45 and 50 each comprise a metal head 57 attached to a shaft 60. The head 57 has a hollow central cavity and perforations through its surface. The cavity is communicatively connected to an air supply (discussed below) to allow air to flow though the perforations. The air flow causes material threaded around the head 57 to float above its exterior surface. A pair of ring shaped clamps 58 and 59 are attached to the exterior of the head 57. The inwardly oriented clamp 59 is fixed in position. The outwardly disposed clamp 58 is adjustable. Material is threaded around the head 57 and between the clamps 58 and 59. The clamps 58 and 59 guide the flow of material around the head 57 in operation. The wind roll holder 52 mounts the core of the new rewound roll. The holder 52 comprises a metal head 70 fixed to, a shaft 71. The shaft is coupled to and driven by the motor 41. The head 70 frictionally engages the wind roll core.

The air guides 45 and 50, and air brake 33 are powered by an air supply system comprising a pump and outfeed line(not shown), an air manifold 54 connected to the outfeed line, a brake and an air guide pressure gauge/controller assembly 55 and 56, respectively, and several air lines connecting the manifold 54, gauge/controller assemblies 55 and 56, air brake 33 and air guides 45 and 50.

Figure 11:
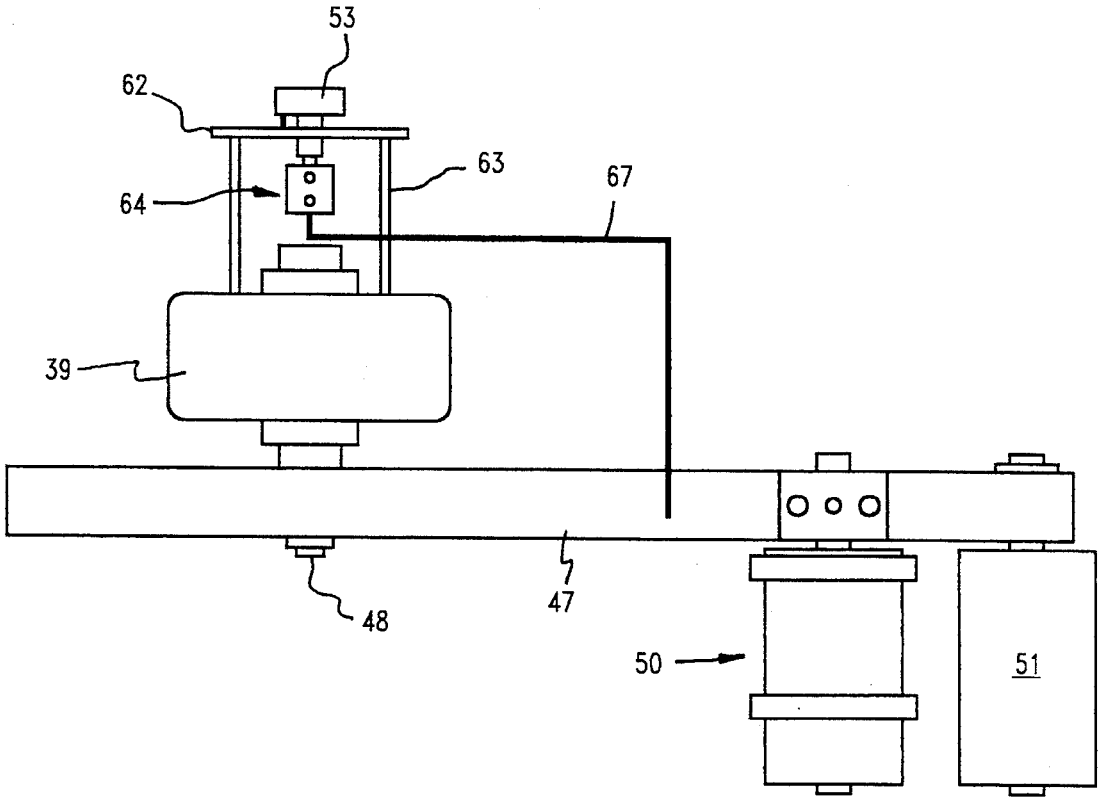
FIG. 11 is a top view of the end of the lay on arm assembly.

Referring to FIGS. 3, 4, 10 and 11, the tension arm 47 is a metal bar which pivots about a rod 48. An adjustable counter weight 49 is disposed at one end of the arm 47 and-the lay-on roller 51 is disposed at the opposite end. The tension arm 47 allows The lay-on roller 51 to remain in rotatable contact with the outer circumference of the expanding wind roll 12 during the rewind process. The contact force of the lay-on roller 51 on the roll 12 is adjusted by manipulation of the counter weight 49. A rheostat 53 is attached to the frame 39 and, indirectly, to the lay on arm 47, via the connection wire 67 and coupling 64. The rheostat 53 is electrically connected to the controller 17 and provides information to the controller 17 about the angular position of the tension arm 47 as the arm 47 rises (due to the increasing diameter of the wind roll 12) during the rewind process. This allows the controller to slow the drive motor 41 speed to maintain a constant speed of take-up at the unwind station 14. As is shown in FIG. 11, the wire 67 contacts the top of the arm 47 and is connected to the frame 39 via a rheostat base plate 62 and spacer 63. The coupling 64 and wire 67 function to insulate the rheostat 53 from shock and ensure that the rheostat 53 shaft will not break during an extreme movement of the arm 47.

The controller 17 is preferably of the type manufactured by Caroteron of Heath Springs, S.C. The controller 17 permits the operator to adjust the material throughput speed of the apparatus 10. The controller 17 is connected to the motor 41 and converts AC from a supply to DC. The controller 17 to the rheostat 53 for rewind speed regulation.

As is shown in FIG. 10, in an operative mode, material extending from the outside edge of the defective unwind roll 11 is threaded around the first roller 22, around the second roller 23 and then around the third roller 24. Material passing over the third roller 24 of the unwind station 14 then extends to the wind station 15 and is threaded under the first air guide 45, around the first roller 46, over the second air guide 50, under the lay-on roller 51 and finally on to the top edge of the wind roll 12. The wind roll 12 is driven and rotates clockwise. The unwind roll 11 is not driven, but rotates counterclockwise as material is pulled from it, through the aforementioned elements. Material extending from the third roller 24 of the unwind station 14 to the airguide 45 of the wind station 15 twists through 90 degrees along the midpoint between the elements 24 and 45.

The rewinder 10 operates on the principle that the unwound material from a malformed roll threaded through a course of multiple rollers which are of a particular type, and disposed in particular directions and predetermined distances from one another permits uniform rewinding of the material onto a new roll at the end of the course. The important features of the course of rollers are:

1. All of the first station 14 rollers, including the unwind roll 11 itself are oriented in a first direction (for example vertically) and all of the second station 15 rollers, including the wind roll 12, are oriented in a second direction which is disposed at a right angle with respect to the direction of the first station 14 rollers (horizontally);

2. The terminal or last roller 24 of the first station 14 is disposed a predetermined distance from the initial roller 45 of the second station 15; and 3. One or more of the rollers of the second station 15 are of an "air guide" design.

The multiple rollers of the first station 15 serve to initially attenuate any "wobble" or misalignment along the axis of the defective roll 11 as the unwound material exits the roll. The conversion from travel in a first plane of orientation (vertical) to travel in the second plane (horizontal) imparts a "twist" to the material along the midpoint of the distance between the first and second stations 14 and 15. The twist in the taut material further attenuates any misalignment. Finally, the air guide rollers 45 and 50 of the second stallion 15 permit uniform realignment of the material prior to its being wound onto wind roll 12.

As many changes are possible to the embodiments of this invention utilizing the teachings thereof, the descriptions above, and the accompanying drawings should be interpreted in the illustrative and not the limited sense.

The invention claimed is:

1. An apparatus for rewinding flexible elongated material from one roll onto another roll, comprising:

(a) an unwind station comprising a holder for a first roll of wound material and first, second and third rotatable guides disposed at predetermined with respect to said holder;

(b) a wind station comprising a frame, a first air guide and a first guide connected to said frame and a holder, connected to said frame for a second roll of wound material, said at least one wind station guide being disposed at a predetermined position with respect to said wind station holder and to said unwind station guide, said wind and unwind stations holders and guides having cylindrical configurations with a shaft and a head, and all of said holders being rotatable, said wind station further comprising a second air guide and a second guide;

(c) means to drive said wind station holder, whereby material extending from said unwind station holder travels around said unwind guide, around said wind station guide and is rewound onto said wind station holder; and (d) a speed regulator for regulating the speed of travel of material from said unwind station holder to said wind station holder, said speed regulator comprising an arm pivotally connected to said frame at one end thereof via a pivot shaft, at least one guide disposed at a second end thereof for contact with the second roll of material, a rheostat connected to said frame and to said arm, and an electronic controller connected to said rheostat and to said drive means, whereby the angular position of said arm is a function of the diameter of said second roll and wherein the increase in said angular position is detected by said rheostat, transmitted to said controller and results in decreasing the speed of said drive means, said wind station second air guide and said second guide being disposed on said arm.

2. The apparatus of claim 1, wherein said material is paper, foil, cloth or polymeric film.

3. The apparatus of claim 1, wherein said unwind station holder and guide are axially oriented in a first direction, and wherein said wind station holder and guide are axially oriented in a second direction which is disposed at a right angle with respect to said first direction.

4. The apparatus of claim 1, further comprising means to positively stop rotation of said unwind station holder.

5. The apparatus of claim 1, wherein said position of said unwind station guide is adjustable and aligned with said wind station guide.

6. The apparatus of claim 1, wherein there are three unwind station guides and four wind station guides, at least one unwind station and at least one wind station guide further being rotatable.

7. The apparatus of claim 6, wherein at least one wind station guide has a pneumatically driven head, whereby material floats above and in proximity to said head.

8. The apparatus of claim 1, further comprising means to limit the angular position of said arm, said means being connected to said arm and to said frame.

9. An apparatus for rewinding flexible elongated material from one roll onto another roll, comprising:

(a) a frame;

(b) an unwind station disposed on said frame and comprising a rotatable holder for a first roll of wound material, at least one intermediary guide disposed at a predetermined position with respect to said holder, a terminal guide having an adjustable position, and means to positively brake rotation of said holder;

(c) a wind station comprising a sub-frame connected to and extending above said frame, at least one guide connected to said sub-frame, an arm pivotally connected at one of its ends to said sub-frame, at least one guide connected to said arm at its opposite end, a holder, disposed on said sub-frame, for a second roll of wound material, and means to limit pivotal motion of said arm;

(d) a motor connected to and driving said wind station; and (e) means to regulate the drive speed of said wind station holder by said motor holder, whereby material extending from said unwind station holder travels around said unwind guides, around said wind station guides and is rewound onto said wind station holder.

10. An apparatus for rewinding flexible elongated material from one detective roll onto a corrected roll, comprising:

(a) a frame;

(b) an unwind station disposed on said frame and comprising a rotatable holder for a first roll of wound material, first and second rotatable intermediary guides disposed at predetermined positions with respect to said holder, a rotatable terminal guide having an adjustable position, and means to positively brake rotation of said holder, said holder and said guides having a cylindrical configuration and being vertically axially oriented with respect to said frame;

(c) a wind station comprising a sub-frame connected to and extending above said frame, a first air driven guide connected to said sub-frame, a first rotatable guide connected to said sub-frame, an arm pivotally connected at one of its ends to said sub-frame, a second rotatable guide connected to said arm at its opposite end, a second air driven guide connected to said arm proximate its midpoint, and a holder, disposed on said sub-frame, for a second roll of wound material;

(d) a motor connected to and driving said wind station holder; and (e) means to regulate the drive speed of said wind station holder by said motor, whereby material extending from said unwind station holder travels around said unwind guides, around said wind station guides and is rewound onto said wind station holder at a substantially constant speed.

* * * * *